US005092089A

United States Patent [19]

Kessler

[11] Patent Number: 5,092,089

[45] Date of Patent: Mar. 3, 1992

[54] SKYLIGHT FRAME

[76] Inventor: Gerald Kessler, P.O. Box 389, Youngstown, Ohio 44501

[21] Appl. No.: 605,310

[22] Filed: Oct. 30, 1990

[51] Int. Cl.[5] ..... E04B 7/18; E04D 13/14

[52] U.S. Cl. ..... 52/200; 49/485

[58] Field of Search ..... 52/200, 72, 403; 49/325, 402, 485, 504

[56] References Cited

U.S. PATENT DOCUMENTS

| | | | |
|---|---|---|---|
| Re. 32,915 | 5/1989 | Jentoft et al. | 52/200 |
| 2,316,442 | 4/1943 | Lootens | 49/485 |
| 3,461,517 | 8/1969 | Eisenhard | 49/485 X |
| 4,409,767 | 10/1983 | Jentoft et al. | 52/200 |
| 4,497,137 | 2/1985 | Nelson | 49/485 X |
| 4,757,655 | 7/1988 | Jentoft et al. | 52/200 |
| 4,862,657 | 9/1989 | Jentoft et al. | 52/200 |

FOREIGN PATENT DOCUMENTS

| | | | |
|---|---|---|---|
| 2728836 | 1/1979 | Fed. Rep. of Germany | 52/200 |

*Primary Examiner*—Richard E. Chilcot, Jr.
*Assistant Examiner*—Joanne C. Downs
*Attorney, Agent, or Firm*—Browdy and Neimark

[57] ABSTRACT

An improved curb frame for a skylight construction is provided in the form of a single extrusion element having an outwardly and downwardly curve sealing lip adapted for engagement with the interior of the retainer of the skylight. The sealing lip, even though formed of rigid plastic, is made sufficiently thin so that it flexes to take up the tolerance between the retainer and the curb frame.

8 Claims, 1 Drawing Sheet

SKYLIGHT FRAME

FIELD OF THE INVENTION

The present inventions relates in general to an improved skylight construction. More particularly, the invention concerns an improved curb frame construction for a skylight, which curb frame incorporates an improved weatherstrip seal.

BACKGROUND OF THE INVENTION

Curb frames for skylight constructions are known, attention being invited for example to Jentoft et al, U.S. Pat. No. Re 32,915, the contents of which are hereby incorporated by reference. The Jentoft et al curb frame includes an outside edge gasket 50, 150 integrally formed with the curb frame but of flexible co-extruded PVC having a durometer A hardness of 72±3, i.e. soft vinyl wherein the remainder of the curb frame, with the exception of another co-extruded gasket portion, is formed of rigid vinyl having a durometer D hardness of 82±3.

A disadvantage of this construction lies in its critical dual durometer construction requiring a 3-section extruder and die which necessitate a substantial capital investment. Dual durometer co-extrusion is also more difficult than single durometer extrusion in that it is more susceptible to the production of unsatisfactory product which must be scraped when inevitable variations occur during the extrusion process. As a result, the curb frame of Jentoft et al U.S. Pat. No. Re 32,915 is more expensive than desirable.

Jentoft et al U.S. Pat. No. 4,862,657 shows a different construction of a curb frame, here referred to as an operating leaf frame or support frame 20, this curb frame having no outside edge gasket whatsoever. In this construction, the curb frame is supported by an inwardly extending flange 38 from the retainer 22. Sealing in this case is accomplished between the retainer 22 and the base frame 14. This construction, particularly adapted for a ventilating skylight, i.e. one which is capable of opening, is considerably more complex and hence more costly than that of the previously mentioned Jentoft et al U.S. Pat. No. Re 32,915.

SUMMARY OF THE INVENTION

It is an object of the present invention to overcome deficiencies in the prior art, such as those mentioned above.

It is another object of the present invention to provide an improved curb frame made entirely of single-extruded, relatively rigid plastic, which is less expensive than prior curb frames, but yet provides a satisfactory outside edge weatherstrip.

It is a further object of the present invention to provide a curb frame for a skylight construction which curb frame has a relatively rigid, integral and unitary side edge weatherstrip portion or sealing lip which permits both easy entry thereover of the skylight retainer and at the same time good weather sealing contact against the interior of such skylight retainer.

These and other objects and the nature and advantages of the present will be more apparent from the following detailed description taken in conjunction with the drawing wherein:

BRIEF DESCRIPTION OF THE DRAWING

The sole FIGURE (FIG. 1) is an enlarged cross section of a curb frame construction in accordance with the present invention in location within a skylight construction, the latter being shown partly broken away.

DETAILED DESCRIPTION OF EMBODIMENT

Figure 1:
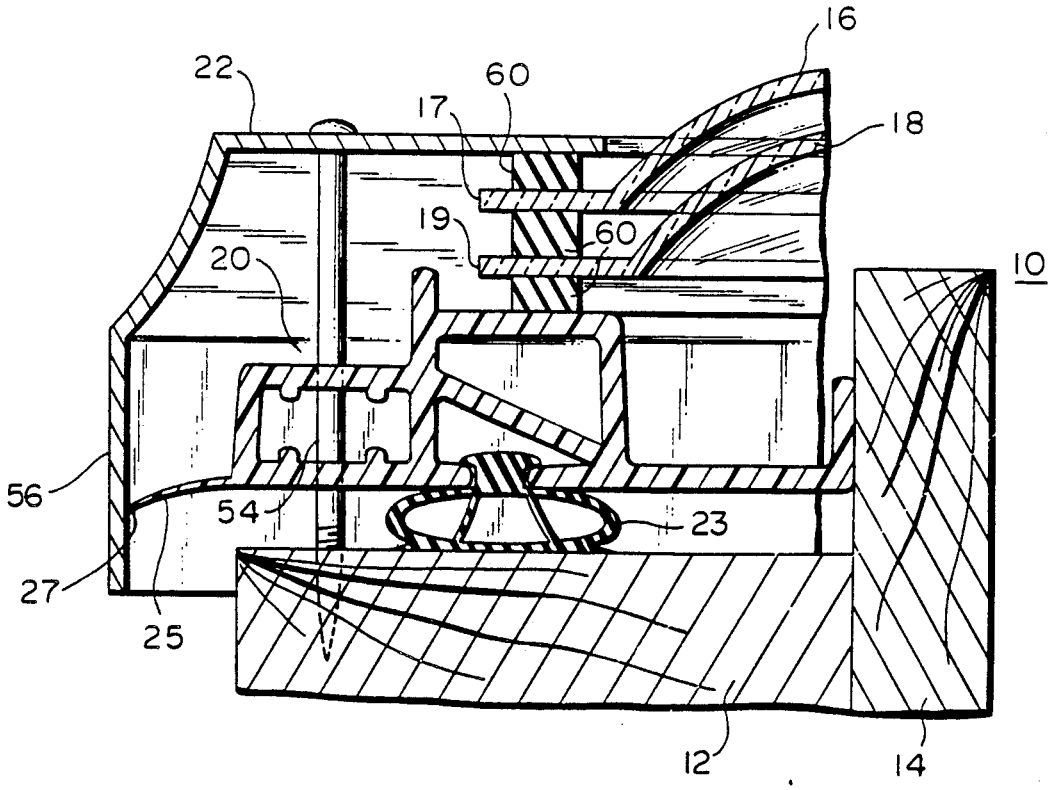

Reference is again made to the aforementioned Jentoft et al U.S. Pat. No. Re 32,915, the subject matter of which is incorporated by reference. The following description uses, where appropriate, the same reference numerals for like parts as in said Jentoft et al U.S. Pat. No. Re 32,915, and familiarity with said patent is assumed in this description. While the present invention is illustrated in conjunction with a domed skylight, it will be understood that it is equally applicable with regard to a flat skylight construction. As illustrated, the skylight spans an opening 10 which may be rectangular, e.g. square, or other shape and which is defined in part by upright walls 12 which may be provided with a finish material 14 on the inside of the opening 10.

The illustrated skyline construction includes a pair of transparent domes 16 and 18 desirably formed of suitable plastic such as acrylic or polycarbonate, a curb frame 20 of strong and rigid thermoplastic material, preferably rigid PVC, and a retainer 22. The curb frame 20 is desirably extruded in straight sections and is secured on the top of the wall 12 as illustrated, with a flexible gasket 23, desirably formed of elastomer or soft plastic, retained in the curb frame 20 and projecting downwardly for seating on the upper end of the upright wall 12. A series of compressible seals 60 are sandwiched respectively between the edges 17 and 19 of the domes 16 and 18, between the edge 19 and the top of the curb frame 20, and between the edge 17 and the bottom of the retainer 22 as shown. After assembly, as illustrated, the construction can be locked in place simply by passing a screws 54 downwardly, at locations beyond the periphery of the flexible gasket 23 and the edges 17 and 19 of the transparent domes 16 and 18, through the retainer 22 and the curb frame 20, and into the upright wall 12.

A key feature of the present invention is the provision of an outside edge gasket, a thin curb lip or flange 25 which extends outwardly from the main part of the curb frame 20 and curves downwardly so that its distal edge 27 comes in contact with and seals against the interior of the retainer 22. It will be understood that even though the curb frame 20, including the outwardly and downwardly curved curb lip 25, is formed of rigid plastic, e.g. vinyl of durometer D hardness of 82±3, the outwardly and downwardly curb lip has a degree of flexibility due to its relative thinness which is on the order of only about 1/32 of an inch. Preferably, the downwardly curved curb lip 25 tapers slightly from a maximum where it is joined to the main part of the curb frame 20 to a minimum at its distal sealing edge 27, this taper being on the order of 30%. In one example, the outwardly and downwardly curved curb lip 25 tapers from a maximum thickness of 0.8 mm to a minimum at its distal edge 27 of 0.55 mm.

During installation of the skylight, it will be understood that the retainer 22 is placed in position over the upper gasket 60 in such a way that its vertical wall 56 comes in contact with the sealing edge 27 of the curb lip 25 causing a slight inward and downward deflection of the lip 25. In this way the lip 25, even though it is formed of rigid plastic, bends enough to take up the tolerance between the retainer 22, desirably formed of aluminum, and the curb frame 20. This structure benefits from a very simple and yet highly effective construction which is not only very inexpensive to produce, but allows easy assembly of the skylight and good contact between the retainer 22 and the curb frame 20.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. In a skylight construction for an opening in a building, comprising a curb frame extending about the opening, translucent or transparent covering means for covering the opening and extending at its edges to the curb frame, and retainer means for retaining the covering means on the curb frame, said curb frame being constructed of a rigid thermoplastic material, the improvement wherein said curb frame has an integral and unitary sealing lip extending outwardly therefrom, said sealing lip being formed of rigid thermoplastic material and having an outwardly and downwardly curved shape, said sealing lip terminating in a sealing edge contacting said retainer, and said sealing lip being sufficiently thin so as to be capable of deforming inwardly upon pressure from said retainer.

2. A skylight construction according to claim 1 wherein said sealing lip has a thickness on the order of about 1/32 inch.

3. A skylight construction according to claim 2 wherein said sealing lip tapers to a minimum thickness at said sealing edge, the degree of taper being on the order of about 30%.

4. In a skylight construction for an opening in a building, comprising a curb frame extending about the opening, translucent or transparent covering means for covering the opening and extending at its edges to the curb frame, and retainer means for retaining the covering means on the curb frame, said curb frame being constructed of a rigid thermoplastic material, the improvement wherein said curb frame has an integral and unitary sealing lip extending outwardly therefrom, said sealing lip being formed of rigid thermoplastic material having a durometer D hardness on the order of $82 \pm 3$ and having an outwardly and downwardly curved shape, said sealing lip terminating in a sealing edge contacting said retainer, and said sealing lip being sufficiently thin so as to be capable of deforming inwardly upon pressure from said retainer.

5. In a skylight construction for an opening in a building, comprising a curb frame extending about the opening, translucent or transparent covering means for covering the opening and extending at its edges to the curb frame, and retainer means for retaining the covering means on the curb frame, said curb frame being constructed of a rigid thermoplastic material, the improvement wherein said curb frame has an integral and unitary sealing lip having upper and lower surfaces extending outwardly therefrom, said sealing lip being formed of rigid thermoplastic material and having an outwardly and downwardly curved shape, said sealing lip terminating in a sealing edge contacting said retainer, and said sealing lip being sufficiently thin so as to be capable of deforming inwardly upon pressure form said retainer, said sealing lip in cross-section having said upper surface convexly curved along its entire width and said lower surface concavely curved along its entire width.

6. A skylight construction according to claim 5 wherein said curb frame including said sealing lip is formed of a rigid plastic having a durometer D hardness on the order of $82 \pm 3$.

7. A skylight construction according to claim 5 wherein said sealing lip has a thickness on the order of about 1/32 inch.

8. A skylight construction according to claim 7 wherein said sealing lip tapers to a minimum thickness at said sealing edge, the degree of taper being on the order of about 30%.

* * * * *